US011746782B2

(12) United States Patent
Palmer et al.

(10) Patent No.: US 11,746,782 B2
(45) **Date of Patent: *Sep. 5, 2023**

(54) LOW COEFFICIENT OF EXPANSION ROTORS FOR BLOWERS

(71) Applicant: GARDNER DENVER, INC., Wayne, PA (US)

(72) Inventors: Roger Clive Palmer, Wayne, PA (US); Kyle Maples, Wayne, PA (US); Vladimir Muzichuk, Wayne, PA (US)

(73) Assignee: Gardner Denver, Inc., Wayne, PA (US)

( * ) Notice: Subject to any disclaimer, the term of this patent is extended or adjusted under 35 U.S.C. 154(b) by 212 days.

This patent is subject to a terminal disclaimer.

(21) Appl. No.: 17/222,497

(22) Filed: Apr. 5, 2021

(65) Prior Publication Data

US 2021/0310487 A1 Oct. 7, 2021

Related U.S. Application Data

(60) Provisional application No. 63/004,784, filed on Apr. 3, 2020.

(51) Int. Cl.
*F04C 18/04* (2006.01)
*F04C 18/16* (2006.01)
(Continued)

(52) U.S. Cl.
CPC ..... *F04C 18/084* (2013.01); *F04C 14/08* (2013.01); *F04C 18/16* (2013.01);
(Continued)

(58) Field of Classification Search
CPC .. F04C 2/126; F04C 2/085; F04C 2/16; F04C 18/084; F04C 18/126; F04C 18/16;
(Continued)

(56) References Cited

U.S. PATENT DOCUMENTS 5,554,020 A 9/1996 Rao et al.
5,638,600 A * 6/1997 Rao ..... F04C 15/0003 29/888.023

(Continued)

FOREIGN PATENT DOCUMENTS

EP 1300592 A2 † 4/2003
WO 2018202520 A1 11/2018
WO 2018202520 A1 † 7/2020

OTHER PUBLICATIONS

Nesbitt, Bruce, "Comfortable coating supercharges Compressor Efficiency," MACHINE DESIGN.com by Engineers for Engineers, Orion Industris, Ltd., dated May 21, 2009.

*Primary Examiner* — Audrey B. Walter
*Assistant Examiner* — Dapinder Singh
(74) *Attorney, Agent, or Firm* — Kevin E. West; Advent, LLP

(57) ABSTRACT

A blower assembly includes, but is not limited to, a blower housing defining a blower chamber and including a gas inlet and a gas outlet; a first rotor positioned within the blower chamber and adapted for rotation therein, the first rotor including a first shaft and at least two lobes defining a first lobe profile; and a second rotor positioned within the blower chamber and adapted for rotation therein, the second rotor including a second shaft and at least two lobes defining a second lobe profile, wherein the first and second rotors are formed from a metal having a coefficient of thermal expansion from about 1 ($10^{-6}$ in/in*K) to about 13 ($10^{-6}$ in/in*K), and wherein at least one of the outer surface of the first rotor, the outer surface of the second rotor, or the blower chamber includes a coating.

19 Claims, 7 Drawing Sheets

(51) Int. Cl.
*F04C 14/08* (2006.01)
*F04C 18/08* (2006.01)

(52) U.S. Cl.
CPC ..... *F04C 2230/91* (2013.01); *F04C 2230/92* (2013.01); *F04C 2240/20* (2013.01); *F04C 2240/40* (2013.01)

(58) Field of Classification Search
CPC ..... F04C 2230/10; F04C 2230/21; F04C 2230/90; F04C 2230/91; F04C 2230/92; F04C 2230/602; F04C 2240/20; F04C 2240/40; F04C 14/08; F01C 1/16; F01C 1/084; F01C 17/02; F05C 2201/046; F05C 2251/042; F05C 2251/14
See application file for complete search history.

(56) References Cited

U.S. PATENT DOCUMENTS

| | | | | |
|---|---|---|---|---|
| 6,688,867 | B2 | 2/2004 | Suman et al. | |
| 8,550,057 | B2 * | 10/2013 | Prior | F02B 33/38 418/206.1 |
| 2008/0107550 | A1 * | 5/2008 | Fujii | F01C 17/02 417/423.1 |
| 2008/0193309 | A1 | 8/2008 | Kothnur et al. | |
| 2008/0292486 | A1 | 11/2008 | Ouwenga | |
| 2010/0209259 | A1 | 8/2010 | Kawamura et al. | |
| 2015/0125312 | A1 * | 5/2015 | Bruce | F04C 28/06 417/45 |
| 2018/0372101 | A1 | 12/2018 | Eybergen et al. | |
| 2020/0240411 | A1 | 7/2020 | Foerster et al. | |
| 2021/0310487 | A1 | 10/2021 | Palmer et al. | |

* cited by examiner
† cited by third party

LOW COEFFICIENT OF EXPANSION ROTORS FOR BLOWERS

BACKGROUND

Positive displacement (PD) blowers utilize rotors that rotate in opposite directions to compress a gas. One type of blower is the roots-type blower. Roots-type blowers utilize two rotors that are positioned within a blower housing. The rotors include lobes that intermesh with each other during rotation. The rotors rotate within the blower housing and can create a positive pressure to provide a pressurized gas for various applications. Another type of blower is the screw type blower. Screw type blowers can include two or more screw rotors that are positioned within a blower housing. The rotors include helical flights that intermesh with each other during rotation.

SUMMARY

In an aspect, a blower assembly includes, but is not limited to, a blower housing defining a blower chamber, the blower housing formed to include a gas inlet for allowing gas to enter the blower chamber and a gas outlet to allow gas to exit the blower chamber; a first rotor positioned within the blower chamber and adapted for rotation therein, the first rotor including a first shaft and at least two lobes having an outer surface that defines a first lobe profile; a second rotor positioned within the blower chamber and adapted for rotation therein, the second rotor including a second shaft and at least two lobes having an outer surface that defines a second lobe profile; and a coating positioned on at least one of an inner surface of the blower chamber or the outer surface of each of the first rotor and the second rotor, the coating including at least one of an abradable coating or a formable coating, wherein the first and second rotors are formed from a metal having a coefficient of thermal expansion from about 1 ($10^{-6}$ in/in*K) to about 13 ($10^{-6}$ in/in*K).

In an aspect, a blower assembly includes, but is not limited to, a blower housing defining a blower chamber, the blower housing formed to include a gas inlet for allowing gas to enter the blower chamber and a gas outlet to allow gas to exit the blower chamber; a first screw rotor positioned within the blower chamber and adapted for rotation therein, the first screw rotor including a first shaft and a first helical flight around the first shaft, the first helical flight having an outer surface that defines a first screw profile; a second screw rotor positioned within the blower chamber and adapted for rotation therein, the second screw rotor including a second shaft and a second helical flight around the second shaft, the second helical flight having an outer surface that defines a second screw profile; and a coating positioned on at least one of an inner surface of the blower chamber or the outer surface of each of the first screw rotor and the second screw rotor, the coating including at least one of an abradable coating or a formable coating, wherein the first screw rotor and the second screw rotor are formed from metal having a coefficient of thermal expansion from about 1 ($10^{-6}$ in/in*K) to about 13 ($10^{-6}$ in/in*K).

In an aspect, a method for forming a blower assembly includes, but is not limited to, forming a blower housing from a metal via investment casting, the blower housing formed to include an interior chamber, a gas inlet for allowing gas to enter the blower chamber, and a gas outlet to allow gas to exit the blower chamber; forming a first rotor from a metal having a coefficient of thermal expansion from about 1 ($10^{-6}$ in/in*K) to about 13 ($10^{-6}$ in/in*K) via investment casting, the first rotor having an outer surface; machining a portion of the outer surface of the first rotor to remove a portion of the metal to define a first rotor profile; forming a second rotor from a metal having a coefficient of thermal expansion from about 1 ($10^{-6}$ in/in*K) to about 13 ($10^{-6}$ in/in*K) via investment casting, the second rotor having an outer surface; machining a portion of the outer surface of the second rotor to remove a portion of the metal to define a second rotor profile; applying a coating including at least one of an abradable coating or a formable coating to one or more of the outer surface of the first rotor, the outer surface of the second rotor, or a surface of the interior chamber of the blower housing; and positioning the first rotor and the second rotor within the interior chamber for rotation therein.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Overview

Blowers have rotational components that intermesh during operation to compress gas received from an inlet to drive a pressurized gas through an outlet of the blower. During operation, the rotational components dimensionally expand as operating temperatures and pressures increase. Dimensional variation in rotational components limits operating efficiencies over various operating conditions and can result in damage at higher temperatures and pressures. Moreover, the rotational components can include smooth surface textures that permit gas to slip past the surfaces of the rotational components during operation, which can decrease blower efficiency and can increase operating temperatures of the blower. At slower rotational speeds of the rotational components, leakage of swept volume back towards the inlet (sometimes referred to as "slip") can be significant. This leakage or slip can significantly lower operational efficiencies of blower units, whereas recirculation of the compressed gas can result in significant heating of the gas, which in turn can cause expansion and damage to the rotors (e.g., through rotor to rotor contact, rotor to housing contact, etc.).

Accordingly, the present disclosure is directed, at least in part, to systems and methods for providing rotors for blower units that have increased operating efficiencies over a wide range of operating temperatures and pressures, which can facilitate use of variable speed drives. The rotors described herein support blower operation at slower speeds, higher temperatures, greater pressures, and with improved mass flows than traditional blowers, resulting in higher thermal and volumetric efficiencies. In an aspect, the blower assemblies described herein utilize rotational components that reduce incidences of "rotor clash," where due to thermal expansion, the rotor expands and contacts the blower housing, resulting in the rotor friction-welding itself to the housing causing a catastrophic failure of the blower.

In an aspect, the rotors are formed from materials having low coefficients of thermal expansion within a blower housing and are provided with a coating to prevent gas slippage past the rotors during operation. In an aspect, the rotors are formed from an investment casting process and machined to include a precise outer profile to ensure strict tolerances between the rotors and between a given rotor and the housing. The rotor profiles and the coating can facilitate low dimensional variation in the rotational components, which can facilitate greater bearing life, higher speeds of rotation, and improved operating efficiencies and ranges.

EXAMPLE IMPLEMENTATIONS

Figure 1:
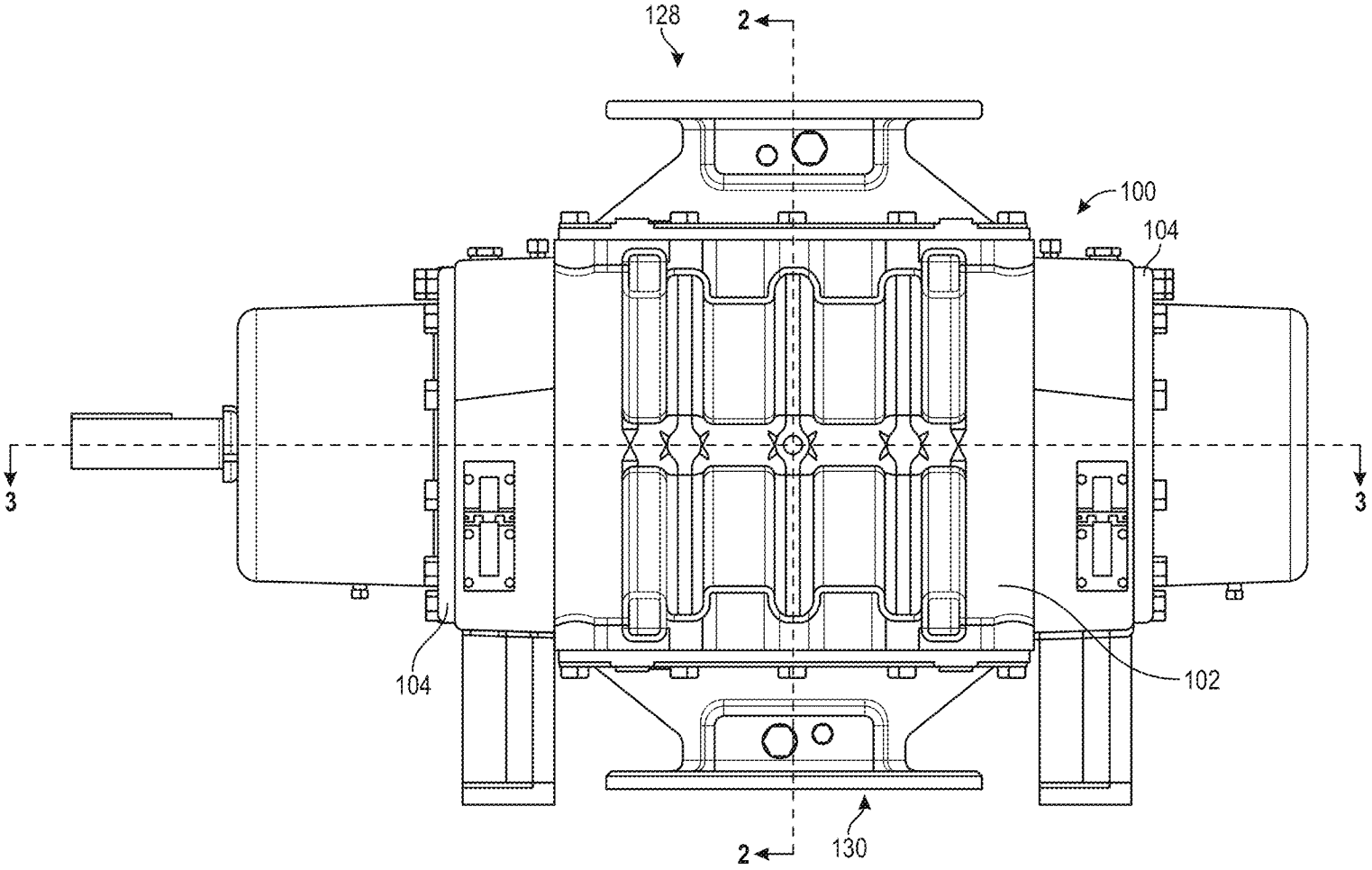
FIG. 1 is an elevation view of a blower assembly in accordance with an example embodiment of the present disclosure.
Figure 2:
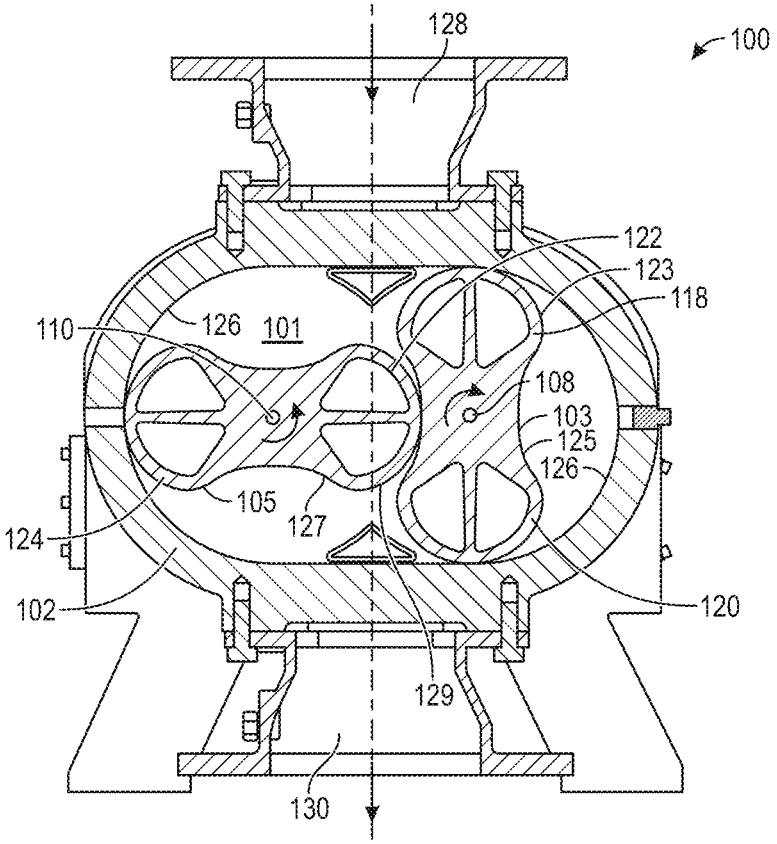
FIG. 2 is a section view taken along line 2-2 of FIG. 1, showing a blower housing containing a pair of intermeshing rotors.

A roots type blower 100 is shown in FIGS. 1 and 2 in accordance with example embodiments of the present disclosure. Blower 100 is adapted to provide vacuum for various industrial applications. Blower 100 includes a blower chamber 101 that is formed by a plurality of components. Blower 100 includes a blower housing 102 and first and second end plates 104 that together form a blower chamber 101. The blower housing 102 is formed to include a gas inlet 128 for allowing gas to enter the blower chamber 101 and a gas outlet 130 to allow gas to exit the blower chamber 101.

Figure 3:
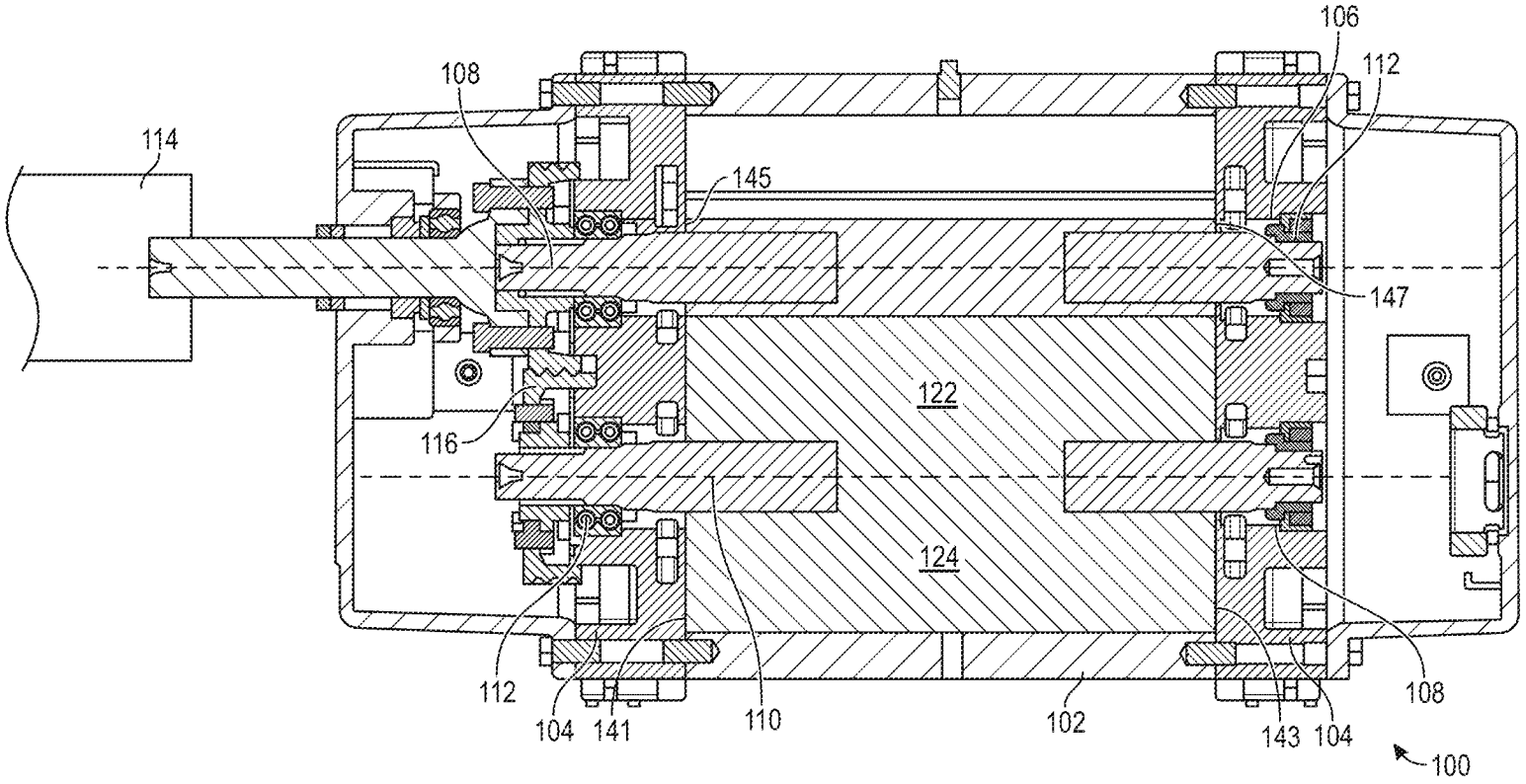
FIG. 3 is a section view taken along line 3-3 of FIG. 1, showing the blower housing and rotors.

Blower 100 includes a first rotor 103 positioned within the blower chamber 101 that is adapted for rotation about a first axis of rotation. For example, the first axis of rotation can extend through ends 145, 147 of the first rotor 103 (e.g., as shown in FIG. 3). The first rotor 103 includes a first shaft 108 and at least two lobes 118 and 120. The lobes 118, 120 include an outer surface 123 that defines a first lobe profile 125.

Blower 100 also includes a second rotor 105 positioned within the blower chamber 101 that is adapted for rotation about a second axis of rotation. For example, the second axis of rotation can extend through ends 141, 143 of the second rotor 105 (e.g., as shown in FIG. 3). In implementations, the second axis of rotation is substantially parallel to the first axis of rotation (e.g., as shown in FIG. 2). The second rotor 105 includes a second shaft 110 and at least two lobes 122, 124. The lobes 122, 124 include an outer surface 127 that defines a second lobe profile 129. In implementations, the first and second rotors 103, 105 are formed from metal having a coefficient of thermal expansion (CTE) from about 1 ($10^{-6}$ in/in*K) to about 13 ($10^{-6}$ in/in*K), for example from about 6 ($10^{-6}$ in/in*K) to about 11 ($10^{-6}$ in/in*K), to limit expansion of the rotors 103, 105 during operation of blower 100 where temperatures can affect rotors 103, 105. Such structural integrity limits unwanted metal to metal contact between the rotors 103, 105 and the blower housing 102 when the blower 100 is run at higher temperatures and pressures.

Figure 4:
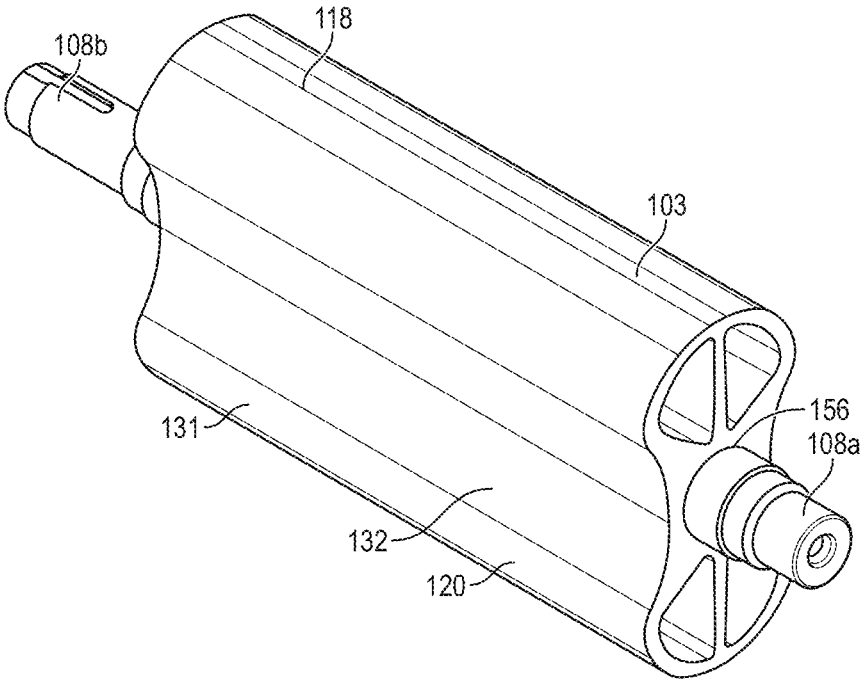
FIG. 4 is perspective view of an assembled rotor for introduction to a blower assembly.
Figure 5:
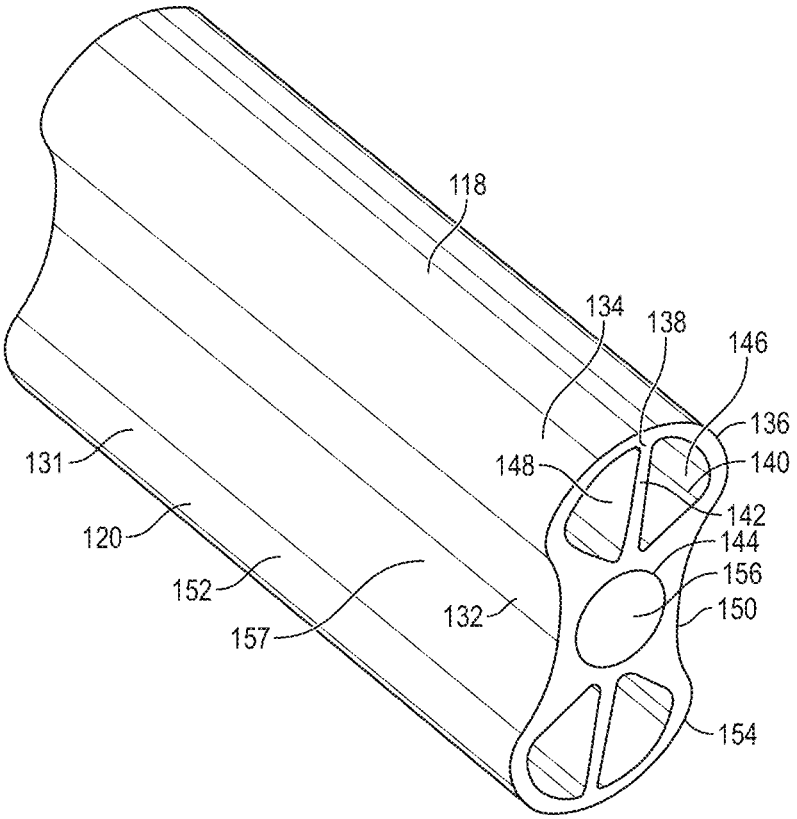
FIG. 5 is a perspective view of the rotor of FIG. 4, shown with the rotor shafts removed.

First and second rotors 103 and 105 can include surface treatments, textures, or materials to facilitate operation of the blower 100 during a wide range of operating conditions while maintaining tolerances between the rotors 103, 105 and the blower housing 102. For example, the first rotor is shown in FIGS. 3-5 including a coating 131 on the outer surface 123. Coating 131 can include, but is not limited to, an abradable coating, a formable coating, or combinations thereof. In implementations, the coating 131 is applied to the first and second rotors 103, 105 in a thickness from about 0.001 inches to about 0.025 inches. For example, coating 131 can be applied to the first and second rotors 103, 105 at a thickness from about 0.001 inches to about 0.006 inches. All or portions of the first and second rotors 103, 105, including the ends of the rotors, can be covered with the coating 131. In implementations, the coating 131 is sprayed onto the first and second rotors 103, 105, the blower housing 102, or combinations thereof, but the coating 131 can be applied by other coating methods. First and second rotors 103 and 105 can include the coating 131 on the outer surfaces 123, 127, onto ends of the respective rotors (e.g., ends 145, 147 of the first rotor 103, ends 141, 143 of the second rotor 105), or combinations thereof.

In implementations, the coating 131 applied to outer surface 123, 127 of the first and second rotors 103, 105 has a surface roughness from about 125 Ra to about 1000 Ra. Surface roughness of rotors 103, 105 is important as testing indicates that a surface roughness in the range of about 125 Ra to about 1000 Ra limits the amount of gas that slips past the rotor lobes (e.g., 118 and 120, 122 and 124) of first and second rotors 103, 105 during operation of the blower 100. Reduction in the amount of gas that slips past the rotor lobes increases blower 100 efficiency and reduces operating temperatures. In implementations, testing the blower 100 at the lower range of operating temperatures during manufacture permits the coating 131 to form and abrade at end use operating and processing conditions (e.g., temperatures, pressures, flows), which can minimize slip or leakage, resulting in higher operating efficiencies at the end use process conditions.

In implementations, the coating 131 is applied in multiple layers. For example, the coating 131 can be applied in two coating layers, three coating layers, or greater than three coating layers. In implementations, the coating 131 is applied in multiple layers and the layers are formed from two or more different coating materials. In implementations, a surface of the blower housing 102 (e.g., forming a boundary of the blower chamber 101) includes an abradable and formable coating. Depending upon manufacturing tolerances between the rotors 103, 105 and the blower housing 102, rotor to rotor contact or rotor to housing contact can cause a portion of the coating 131 from the first and second rotors 103, 105 to partially transfer onto a portion of the blower housing 102 during operation of the blower 100. The coating 131 applied to the rotors 103, 105 preferably can include a coefficient of friction from about 0.04μ to about 0.2μ. In implementations, the coating 131 includes a lubricant including, but not limited to, polytetrafluoroethylene (PTFE), graphite, molybdenum disulfide, or combinations thereof, to provide lubricity between the rotors 103, 105. In various operating scenarios, the use of a lubricant in the coating 131 allows for tighter tolerances between the rotors 103, 105 and the blower housing 102 than if no lubricant is included. In implementations, the blower 100 is manufactured so that the operating clearances between the first and second rotors 103, 105 when assembled into blower housing 102 is from about 0.003 inches to about 0.032 inches and the operating clearances between the rotors 103, 105 and the blower housing 102 is from about 0.002 inches to about 0.025 inches.

Rotors 103, 105 used in the blower 100 are manufactured from a low CTE material, which limits thermal expansion of the rotors 103, 105 during operating the blower 100 at higher temperatures and pressures. In implementations, the first and second rotors 103, 105 are formed from a metal that includes from about 50% to about 100% iron. The first and second rotors 103, 105 can also include nickel, for example, nickel in an amount from about 20% to about 35% nickel. The first and second rotors 103, 105 can also include cobalt, for example, cobalt in an amount from about 10% to about 25% cobalt.

Blower 100 is shown with the blower housing 102 and two transverse end plates 104. The end plates 104 include apertures 106 through which two rotor shafts 108, 110 extend. Shafts 108, 110 are supported at each end by bearings 112. In implementations, a motor 114 drives rotation of one shaft 108 and a gear mechanism 116 transmits the rotational power to the other shaft 110. The gear mechanism causes the shafts 108, 110 to rotate in synchronization in opposite directions. The first rotor 103 with rotor lobes 112, 120 is mounted to the shaft 108, which provides rotation to the first rotor 103 during operation of the motor 114. The second rotor 105 with rotor lobes 122, 124 is mounted to the shaft 110, which provides rotation to the second rotor 105 during operation of the motor 114 (e.g., via the gear mechanism 116). As the shafts 108, 110 rotate, the lobes 118, 120 and 122, 124 sweep past an internal surface 126 of the blower chamber 101 thereby moving gas from a chamber inlet 128 to a chamber outlet 130 (e.g., shown in FIGS. 1 and 2). The tolerances between the rotor lobes 118, 120 and 122, 124 and the internal surface 126 are controlled to avoid gaps between the rotor lobes 118, 120 and 122, 124 and the internal surface 126 through which gas can pass, which would decrease the efficiency of the blower 100. Similarly, the tolerances between the first and second rotors 103, 105 are controlled to avoid gaps between the portions of the first and second rotors 103, 105 that interact during rotation through which gas can pass, which would decrease the efficiency of the blower 100.

Referring to FIGS. 2-5, the first rotor 103 is shown including the first lobe 118 and opposed second lobe 120. First and second lobes 118, 120 are interconnected by a base 132. While a double lobe rotor arrangement is shown for the first and second rotors 103, 105, it is contemplated that a triple or butterfly type lobe arrangement could also be used to form the first and second rotors 103, 105. In implementations, the first and second rotors 103, 105 are formed using machining, solid casting, investment casting, precision casting, or combinations thereof. Investment casting is an industrial process based on lost-wax casting.

The lobes 118, 120 and 122, 124 of the first and second rotors 103, 105 can include structural features that provide structural stability of the lobes 118, 120 and 122, 124 under high operating temperatures, pressures, and speeds. For example, the lobe 118 of the first rotor 103 can be formed with a first sidewall segment 134 and a second side wall segment 136 (e.g., as shown in FIGS. 3-5), where the first and second sidewall segments 134, 136 interconnect at an apex 138 of the lobe 118. In implementations, the first and second sidewall segments 134, 136 are convex-shaped to form the lobe 118 and to include an interior cavity 140 that is defined by the first and second sidewall segments 134, 136.

Figure 7:
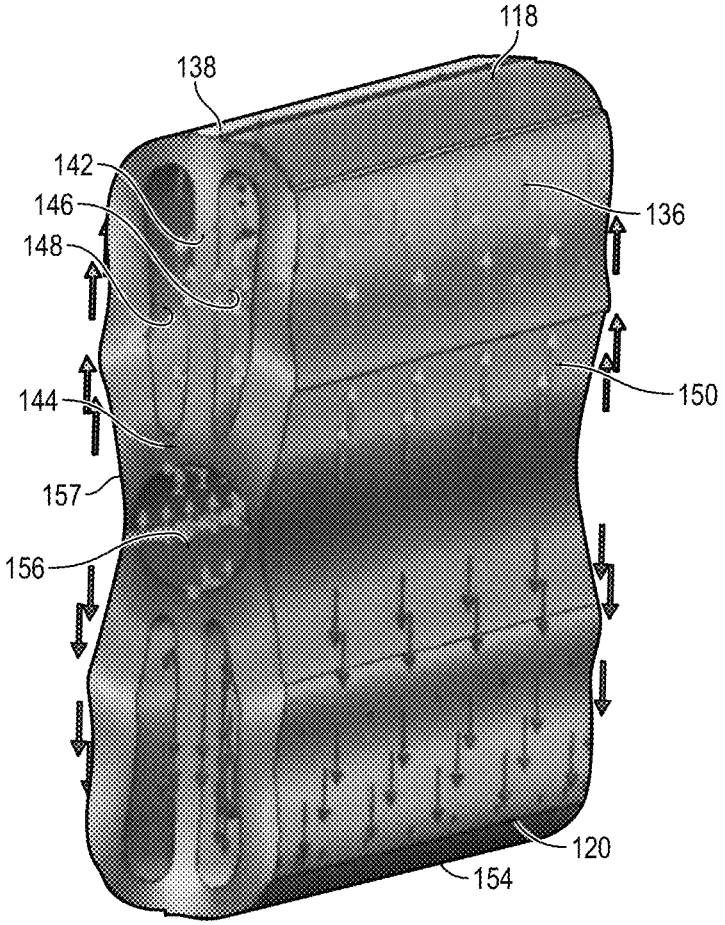
FIG. 7 is perspective view of a rotor for a blower assembly showing stresses in the rotor during operating conditions.

Lobe 118 of the first rotor 103 may also include a tensile bar 142, examples of which are shown in FIGS. 5 and 7. Tensile bar 142 extends from a base 144 of the lobe 118 to the apex 138. In implementations, the tensile bar 142 divides the interior cavity 140 into a first chamber 146 and a second chamber 148, where the first and second sidewall segments 134, 136 define a boundary of a portion of the first chamber 146 and the second chamber 148. In implementations, the tensile bar 142 is formed as a singled piece with the lobe 118. Alternatively or additionally, the tensile bar 142 or portions thereof may be manufactured as a separate piece having the same or different CTE from the lobe 118 and affixed to the lobe 118 and the base 144. Tensile bar 142, in combination with first and second chambers 146, 148 provides a support structure that maintains stability of the lobe 118 under high operating temperatures, pressures, and speeds. For example, the tensile bar 142 allows for minimal deflection of the apex 138 and first and second sidewall segments 134, 136 of the lobe 118 during operating conditions, as shown in FIG. 7. In implementations, the second lobe 120 of the first rotor 103 has substantially the same structure of the first lobe 118 to provide a substantially symmetrical rotor shape, to provide substantially identical lobes shapes, or combinations thereof.

Figure 6:
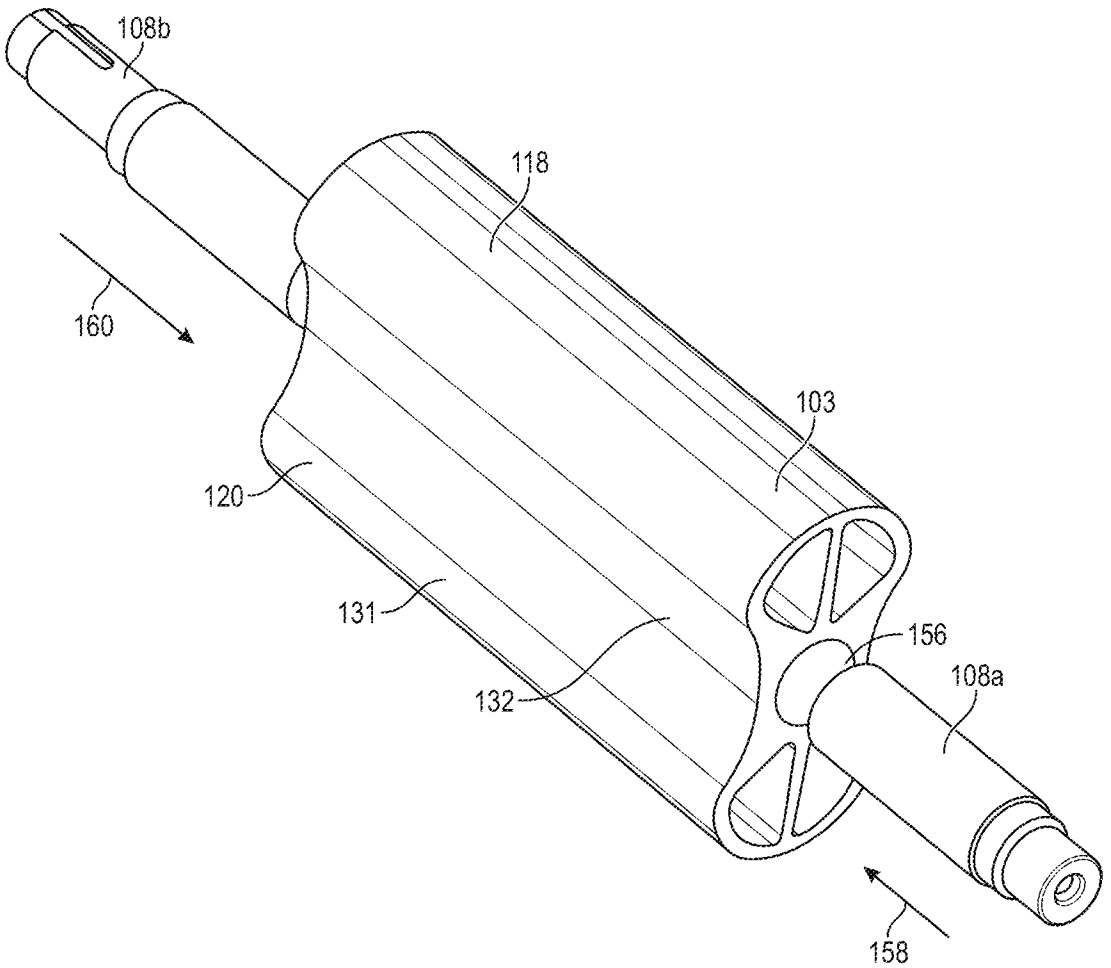
FIG. 6 is a perspective view of the rotor of FIG. 4, shown with a pair of shafts ready to be introduced to openings formed in the rotor.

Base 132 of the first rotor 103 interconnects the first and second lobes 118, 120. Base 132 includes a first concave side wall 157 and an opposed second concave side wall 150. First concave side wall 157 interconnects the first sidewall segment 134 of first lobe 118 with a first sidewall segment 152 of the second lobe 120. Similarly, the second concave sidewall 150 interconnects the second sidewall segment 136 of the first lobe 118 with a second sidewall segment 154 of the second lobe 120. In implementations, the base 132 of the first rotor 103 is formed to include a cylindrical bore 156 that extends at least partially through the first rotor 103. Cylindrical bore 156 of the base 132 of the first rotor 103 is adapted to accept first and second rotor shaft segments 108*a*, 108*b*, as shown, for example, in FIG. 4. First and second rotor shaft segments 108*a*, 108*b* are adapted to be press fit or otherwise inserted into the cylindrical bore 156 in directions 158, 160 to form a completed rotor assembly, as shown in FIG. 6. Alternatively or additionally, one or more of the shaft segments 108*a*, 108*b* can be cast into the first rotor 103. Alternatively, a continuous shaft can be used in place of the first and second rotor shaft segments 108*a*, 108*b*, with the cylindrical bore 156 extending through the base 132. The combined first and second rotors 103, 105 and shaft portions can be then installed inside of the blower chamber 101.

In implementations, the first and second rotors 103, 105 are investment cast from a material having a low coefficient of thermal expansion (CTE). Use of a low CTE material to form the first and second rotors 103, 105 reduces the thermal growth of the first and second rotors 103, 105 during operation, allowing for a higher temperature and pressure operation. Low CTE materials that can be used for investment casting the first and second rotors 103, 105 include cast iron, which has a CTE of about 11 ($10^{-6}$ in/in*K). Materials with lower CTE can also be used to investment cast rotors such as the material KOVAR™, which has a CTE of about 6 ($10^{-6}$ in/in*K), INVAR™ which has a CTE of about 4 ($10^{-6}$ in/in*K), and SUPER INVAR™, which has a CTE of about 1.5 ($10^{-6}$ in/in*K). Materials with a high CTE, such as aluminum, are generally avoided as the thermal expansion of the aluminum metal is too great to gain the desired efficiencies.

Figure 8:
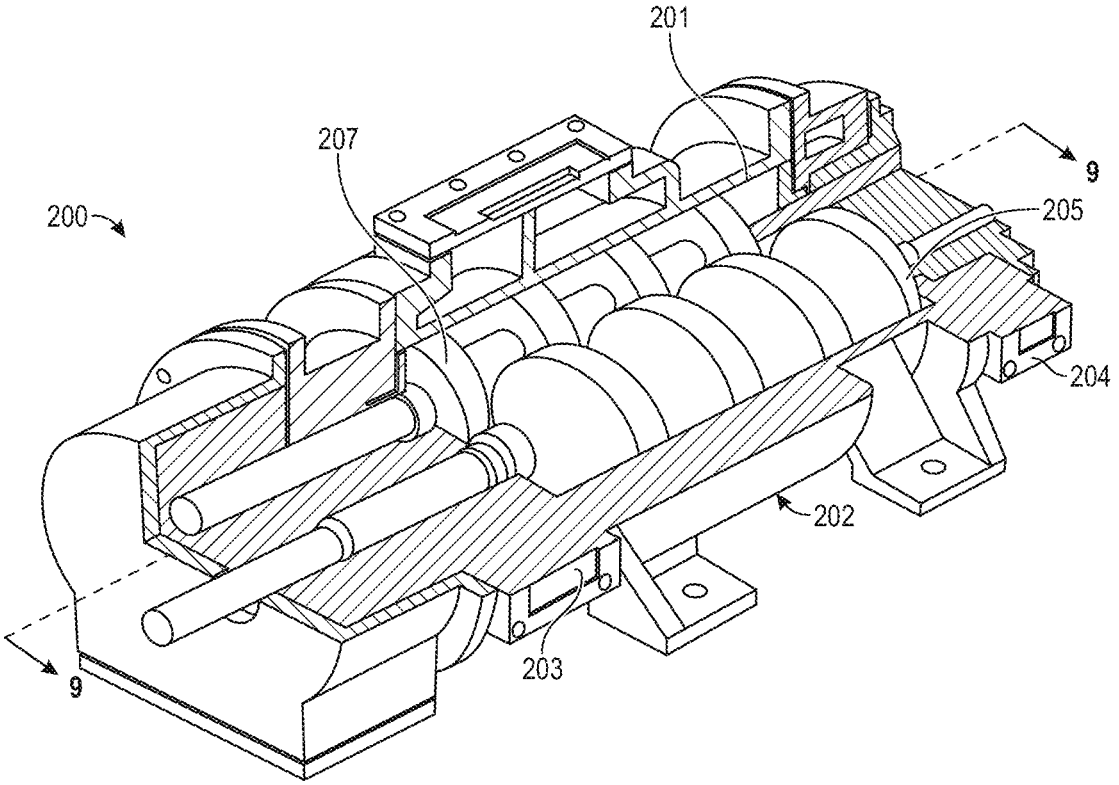
FIG. 8 is a cutaway perspective view of a blower assembly having screw-type rotors positioned within the blower housing in accordance with an example embodiment of the present disclosure.
Figure 9:
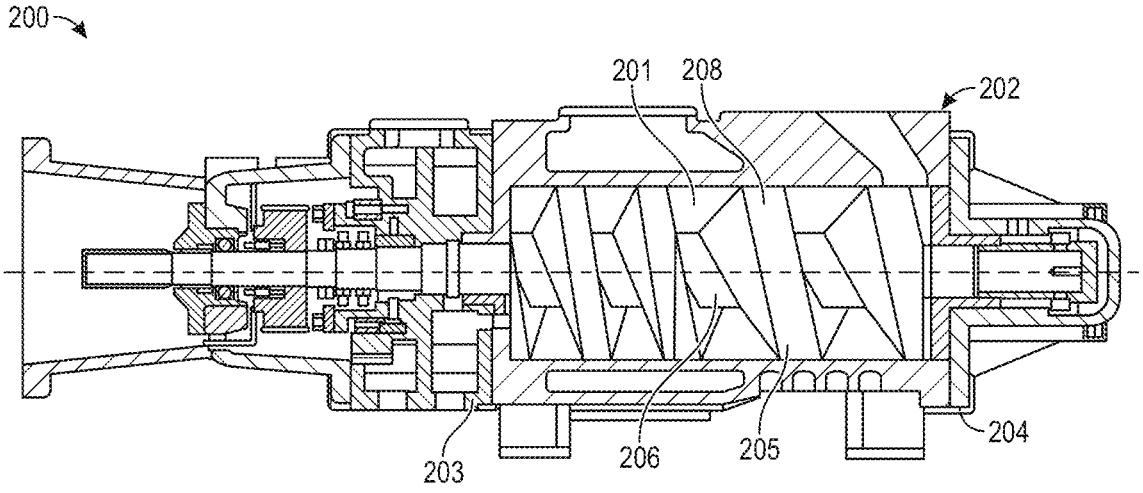
FIG. 9 is a section view taken along line 9-9 of FIG. 8, showing a screw-type rotor positioned within the blower housing.

The blower 100 can include other rotor configurations to facilitate generating a vacuum for industrial applications. For example, referring to FIG. 8, a blower 200 is shown including a screw-type rotor mechanism. Blower 200 includes a blower housing 202 having first and second end plates 203, 204 that together form a blower chamber 201. The blower housing 202 includes a gas inlet for allowing gas to enter the blower chamber 201 and a gas outlet to allow gas to exit the blower chamber. The blower housing 202 includes a first screw rotor 205 positioned within the blower chamber 201. The first screw rotor 205 is adapted for rotation in the blower housing 202 and includes a first shaft 206 and a helical flight 208 around the first shaft. The helical flight 208 includes an outer surface that defines a first screw profile. Blower 200 also includes a second screw rotor 207 positioned within the blower housing 202. The second screw rotor 207 is adapted for rotation in the blower housing 202 and includes a second shaft and a helical flight around the second shaft. The helical flight of the second shaft includes an outer surface that defines a second screw profile. First and second screw rotors 205, 207 are formed from metal having a coefficient of thermal expansion from about 1 ($10^{-6}$ in/in*K) to about 13 ($10^{-6}$ in/in*K). The flights of the first and second screw rotors 205, 207 are coated with an abradable coating, a formable coating, or a combination of an abradable and formable coating.

Low CTE rotors have more dimensional stability than high CTE rotors across a broader range of temperatures and pressures. The dimensional stability allows the low CTE rotors to be used in combination with abradable and formable (A/F) coatings. Under extreme operating conditions of pressure and high temperatures, A/F coated traditionally-structured rotors would thermally grow in dimension and so abrade the coatings, creating larger coating gaps when the rotors return (and shrink) to normal operating conditions of temperature and pressure. The more thermally stable A/F coated low CTE rotors described herein have smaller gaps between the coated rotors and the housing under a range of operating temperatures and pressures, improving overall efficiencies and lower operating temperatures due to less slip between the rotors and housing. In implementations, the A/F coating is an ultra-thin closed cell polymer coating that includes polyamide resin, wear resistant particles (e.g., nanometer-scale particles), and a solid lubricant (e.g., PTFE). One example A/F coating is DB L-908 by Orion Industries. The coating can be applied to the rotors using spraying, powder coating, or other coating techniques. In implementations, the coating is applied to the rotors (103, 105, 205, 207), the blower housing (102, 202), or combinations thereof as a permanent application.

Reducing clearance between the rotors for a blower or screws or cylinder for a vacuum pump reduces the slip and blowby of the blower to improve efficiency. The A/F coating can be applied to one or more of the rotors, the housing, or the end plates to improve blower efficiency. A zero clearance in the blower is created by having a line-on-line contact or slight interference between the first and second rotors 103, 105. During an initial run-in of the blower 100, the first and second rotors 103, 105 are rotated, which abrades and forms the A/F coating to a near zero clearance condition. Using an A/F coating on the CTE rotors reduces the tolerances required in manufacturing the rotors, making the manufacturing of the rotors more cost effective. Additionally, having dimensionally stable, material-optimized rotors can facilitate greater bearing life and higher speeds of rotation.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A blower assembly comprising:

a blower housing defining a blower chamber, the blower housing formed to include a gas inlet for allowing gas to enter the blower chamber and a gas outlet to allow gas to exit the blower chamber;

a first rotor positioned within the blower chamber and adapted for rotation therein, the first rotor including a first shaft and at least two lobes having an outer surface that defines a first lobe profile;

a second rotor positioned within the blower chamber and adapted for rotation therein, the second rotor including a second shaft and at least two lobes having an outer surface that defines a second lobe profile; and a coating positioned on at least one of an inner surface of the blower chamber or the outer surface of each of the first rotor and the second rotor, the coating including at least one of an abradable coating or a formable coating, wherein the first and second rotors are formed from a metal having a coefficient of thermal expansion from 1 ($10^{-6}$ in/in*K) to 13 ($10^{-6}$ in/in*K), and wherein the first and second rotors are formed from a metal including at least 50% iron, 20% to 35% nickel, and 10% to 25% cobalt.

2. The blower assembly of claim 1, wherein a portion of the coating has a thickness from 0.001 inches to 0.025 inches.

3. The blower assembly of claim 2, wherein a portion of the coating has a surface roughness from 125 Ra to 1000 Ra.

4. The blower assembly of claim 1, wherein the coefficient of thermal expansion of the first and second rotors is from 6 ($10^{-6}$ in/in*K) to 11 ($10^{-6}$ in/in*K).

5. The blower assembly of claim 4, wherein a portion of the coating has a thickness from 0.001 inches to 0.006 inches.

6. The blower assembly of claim 5, wherein a portion of the coating has a surface roughness from 125 Ra to 1000 Ra.

7. The blower assembly of claim 1, wherein the coating includes at least two layers formed from two different materials.

8. The blower assembly of claim 1, wherein the coating is positioned on the outer surface of each of the first rotor and the second rotor, and wherein a portion of the coating from the first and second rotors partially transfers onto a portion of the blower housing during operation of the blower assembly.

9. The blower assembly of claim 1, including an operating clearance between the first and second rotors from 0.003 inches to 0.032 inches and an operating clearance between the first rotor and the housing from 0.002 inches to 0.025 inches.

10. The blower assembly of claim 1, wherein the coating includes one or more of a PTFE, a graphite, or molybdenum disulfide.

11. The blower assembly of claim 1, further comprising a variable speed driver motor coupled with the first rotor and the second rotor to drive rotation of the first rotor and the second rotor within the blower chamber.

12. A blower assembly comprising:

a blower housing defining a blower chamber, the blower housing formed to include a gas inlet for allowing gas to enter the blower chamber and a gas outlet to allow gas to exit the blower chamber;

a first screw rotor positioned within the blower chamber and adapted for rotation therein, the first screw rotor including a first shaft and a first helical flight around the first shaft, the first helical flight having an outer surface that defines a first screw profile;

a second screw rotor positioned within the blower chamber and adapted for rotation therein, the second screw rotor including a second shaft and a second helical flight around the second shaft, the second helical flight having an outer surface that defines a second screw profile; and a coating positioned on at least one of an inner surface of the blower chamber or the outer surface of each of the first screw rotor and the second screw rotor, the coating including at least one of an abradable coating or a formable coating, wherein the first screw rotor and the second screw rotor are formed from metal having a coefficient of thermal expansion from 1 ($10^{-6}$ in/in*K) to 13 ($10^{-6}$ in/in*K), and wherein the first and second rotors are formed from a metal including at least 50% iron, 20% to 35% nickel, and 10% to 25% cobalt.

13. The blower assembly of claim 12, wherein a portion of the coating has a thickness from 0.001 inches to 0.025 inches and a surface roughness from 125 Ra to 1000 Ra.

14. The blower assembly of claim 12, wherein the coefficient of thermal expansion of the first and second rotors is from 6 ($10^{-6}$ in/in*K) to 11 ($10^{-6}$ in/in*K), and wherein a portion of the coating has a thickness from 0.001 inches to 0.006 inches.

15. The blower assembly of claim 12, wherein a portion of the coating from the housing partially transfers onto a portion of the rotors during operation of the blower assembly.

16. A method for forming a blower assembly comprising:

forming a blower housing from a metal via investment casting, the blower housing formed to include an interior chamber, a gas inlet for allowing gas to enter the blower chamber, and a gas outlet to allow gas to exit the blower chamber;

forming a first rotor from a metal having a coefficient of thermal expansion from 1 ($10^{-6}$ in/in*K) to 13 ($10^{-6}$ in/in*K) via investment casting, the first rotor having an outer surface;

machining a portion of the outer surface of the first rotor to remove a portion of the metal to define a first rotor profile;

forming a second rotor from a metal having a coefficient of thermal expansion from 1 ($10^{-6}$ in/in*K) to 13 ($10^{-6}$ in/in*K) via investment casting, the second rotor having an outer surface, wherein the first and second rotors are formed from a metal including at least 50% iron, 20% to 35% nickel, and 10% to 25% cobalt;

machining a portion of the outer surface of the second rotor to remove a portion of the metal to define a second rotor profile;

applying a coating including at least one of an abradable coating or a formable coating to one or more of the outer surface of the first rotor, the outer surface of the second rotor, or a surface of the interior chamber of the blower housing; and positioning the first rotor and the second rotor within the interior chamber for rotation therein.

17. The method of claim 16, wherein an operating clearance between the first rotor and the second rotor when positioned within the interior chamber is from −0.001 inches to 0.032 inches, and wherein an operating clearance between the first rotor and the blower housing is from −0.001 inches to 0.025 inches when the first rotor is positioned within the interior chamber.

18. The method of claim 16, wherein each of the first rotor and the second rotor is a screw rotor.

19. The method of claim 16, wherein each of the first rotor and the second rotor includes at least two lobes.

* * * * *